US007909623B2

(12) United States Patent
Lee

(10) Patent No.: US 7,909,623 B2
(45) Date of Patent: Mar. 22, 2011

(54) WEDGE OF A CABLE CONNECTOR GROUNDING DEVICE

(76) Inventor: Chun-Te Lee, Taichung (TW)

( * ) Notice: Subject to any disclaimer, the term of this patent is extended or adjusted under 35 U.S.C. 154(b) by 74 days.

(21) Appl. No.: 12/425,823

(22) Filed: Apr. 17, 2009

(65) Prior Publication Data

US 2010/0267258 A1 Oct. 21, 2010

(51) Int. Cl.
*H01R 4/66* (2006.01)

(52) U.S. Cl. ..... 439/97

(58) Field of Classification Search ..... 439/811, 439/812, 97

See application file for complete search history.

(56) References Cited

U.S. PATENT DOCUMENTS

| | | | | |
|---|---|---|---|---|
| 2,699,601 | A * | 1/1955 | Darnell | 269/40 |
| 3,539,977 | A * | 11/1970 | Woertz | 439/811 |
| 4,213,669 | A * | 7/1980 | Wittes et al. | 439/811 |
| 6,186,839 | B1 * | 2/2001 | Storey et al. | 439/812 |

* cited by examiner

*Primary Examiner* — Alexander Gilman

(74) *Attorney, Agent, or Firm* — Ming Chow; Sinorica, LLC

(57) ABSTRACT

A wedge of a cable connector grounding device includes a body. One side of the body is formed with a spirally conjunct seat inside which a concave spirally conjunct slot is formed. Two concave slots opposite to each other are formed. At the bottom of spirally conjunct slot, a position limiting groove is formed from the concave slots towards the center and a concave camber is formed along the circumferential wall toward the center. A wedge crest line is defined at a section of connection between the concave camber and the position limiting groove. A packing unit is provided and spirally connected to the spirally conjunct slot. The packing unit may be used to tighten the lead wire passing through the position limiting groove for achievement of the longitudinal position limiting. The wedge crest lines are used to wedge the lead wire transversally and tighten the lead wire.

5 Claims, 5 Drawing Sheets

WEDGE OF A CABLE CONNECTOR GROUNDING DEVICE

BACKGROUND OF THE INVENTION

1. Field of the Invention

This invention relates to a wedge of a cable connector grounding device.

2. Description of the Prior Art

With reference to FIG. 1, a 3D view of a conventional cable central connector, the cable connector mainly comprises a body 1. One side of the body 1 is formed with a spirally conjunct seat 2 inside which a concave tapped hole 3 is formed. Then, on the circumferential wall of spirally conjunct seat 2, two concave slots 4 opposite to each other are formed axially for a lead wire 6 of a grounding wire 5 to pass into. Further, an arc-shaped slot 7 conjunct to the slots 4 is formed at the bottom of tapped hole 3. Next, a packing seat 8 is spirally conjunct to the tapped hole 3, and a concave arc-shaped slot 9 is further formed at the bottom of packing seat 8.

With reference to FIG. 2, a schematic view illustrating the service of conventional cable central connector, although the conventional cable connector can be wedged to the lead wire 6 of grounding wire 5, the diameter of lead wire 6 is smaller than that of each of the arc-shaped slots 7 and 9, only points A and B of the lead wire 6 contact the arc-shaped slots 7 and 9, poor contact being thereby caused. Then, the arc-shaped slot 7 is a groove of which the surface is flat and smooth, so the resistance resulting from the lead wire 6 relatively decreases. Further, when being subject to a force and pulled and dragged, the lead wire 6 glides along the arc-shaped slot 7, there being thereby the possibility of poor tightness and clearance. Apparently, the effect of grounding is not achieved. Thus, improvement of the conventional cable central connector is necessarily made.

Consequently, because of the technical defects of described above, the applicant keeps on carving unflaggingly through wholehearted experience and research to develop the present invention, which can effectively improve the defects described above.

SUMMARY OF THE INVENTION

A wedge of a cable connector grounding device according to this invention comprises a body. One side of the body is formed with a spirally conjunct seat inside which a concave spirally conjunct slot is formed. Then, on the circumferential wall of spirally conjunct seat, two concave slots opposite to each other are formed. Further, at the bottom of spirally conjunct slot, a position limiting groove is formed from the concave slots towards the center. Next, at the bottom of spirally conjunct slot, a concave camber is formed along the circumferential wall toward the center. A wedge crest line is defined at a section of connection between the concave camber and the position limiting groove. A packing unit is further provided is spirally connected to the spirally conjunct slot.

Thus, the packing unit can be used to tighten the lead wire passing through the position limiting groove for achievement of the longitudinal position limiting. The wedge crest lines are used to wedge the lead wire transversally and further tighten the lead wire.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
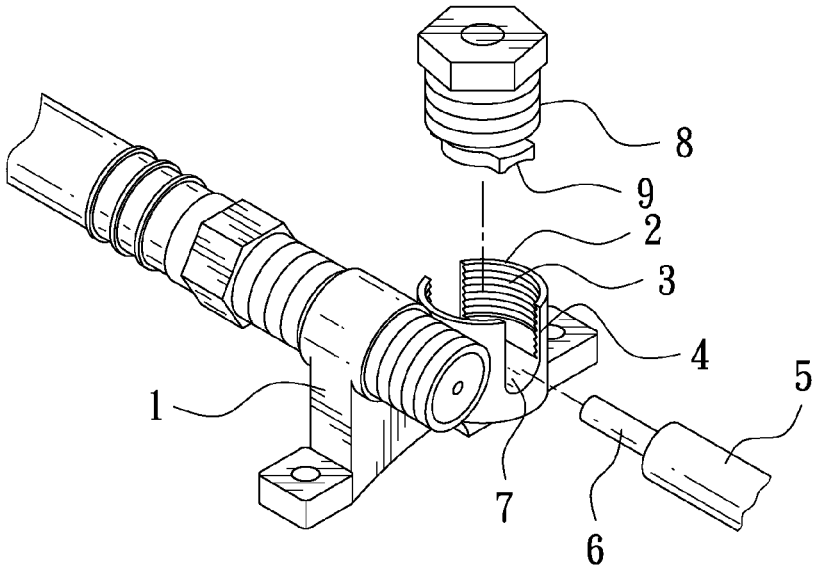
FIG. 1 PRIOR ART
FIG. 1 is a 3D view of a conventional cable central connector.
Figure 2:
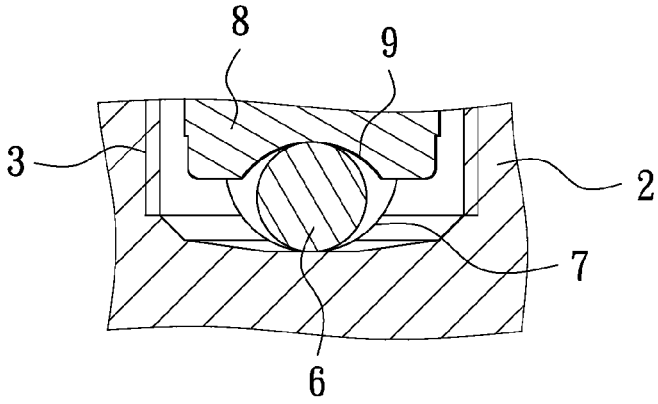
FIG. 2 PRIOR ART
FIG. 2 is a schematic view illustrating the service of conventional cable central connector.
Figure 3:
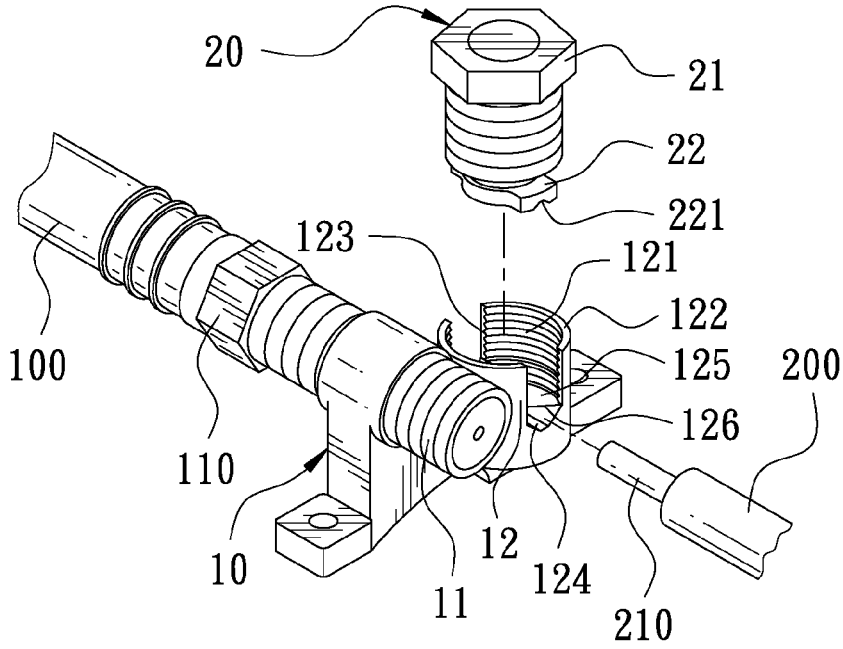
FIG. 3 is a partially exploded 3D view of a cable connector according to this invention.
Figure 4:
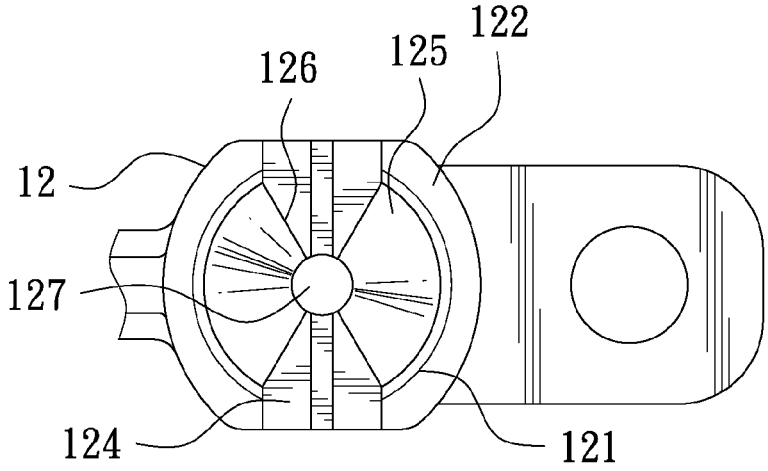
FIG. 4 is a top view of a spirally conjunct seat according to this invention.

With reference to FIGS. 3 and 4 shown respectively as a partially exploded 3D view of a cable connector according to this invention and as a top view of a spirally conjunct seat, this invention mainly comprises a body 10 and a packing unit 20.

The body 10 is provided with two male joints 11 connected to each other, and the male joints 11 can be spirally conjunct to female joints 110 of two cables 100. One side of the body 10 is formed with a spirally conjunct seat 12. A concave spirally conjunct slot 121 is formed in the spirally conjunct seat 12 and a circumferential wall 122 is defined around the circumference of spirally conjunct slot 121. The circumferential wall 122 is lengthways formed with two concave slots 123 opposite to each other are formed into which a lead wire 210 of a grounding wire 200 passes. Further, the bottom of spirally conjunct slot 121 is formed with a concave position limiting groove 124 toward the center of each of the slots 121, and the position limiting groove 124 is generally a V-formed groove and brings to an end from the circumference of each of the slots 123 toward the center of spirally conjunct seat 12. Next, at the bottom of spirally conjunct slot 121, a concave camber 125 is formed along the circumferential wall 122. Each of the concave cambers 125 is generally in the form of a conic surface and is depressed by degree from the edge of inner side of the circumferential wall 122 toward the center of spirally conjunct seat 12. A wedge crest line 126 is defined at a section of connection between the concave camber 125 and the position limiting groove 124. Each of the wedge crest lines 126 brings to an end from the inner side of circumferential wall 122, slanting toward the center of spirally conjunct seat 12. Besides, the center of bottom of the spirally conjunct slot 121 is formed with a concave container chamber 127.

Figure 5:
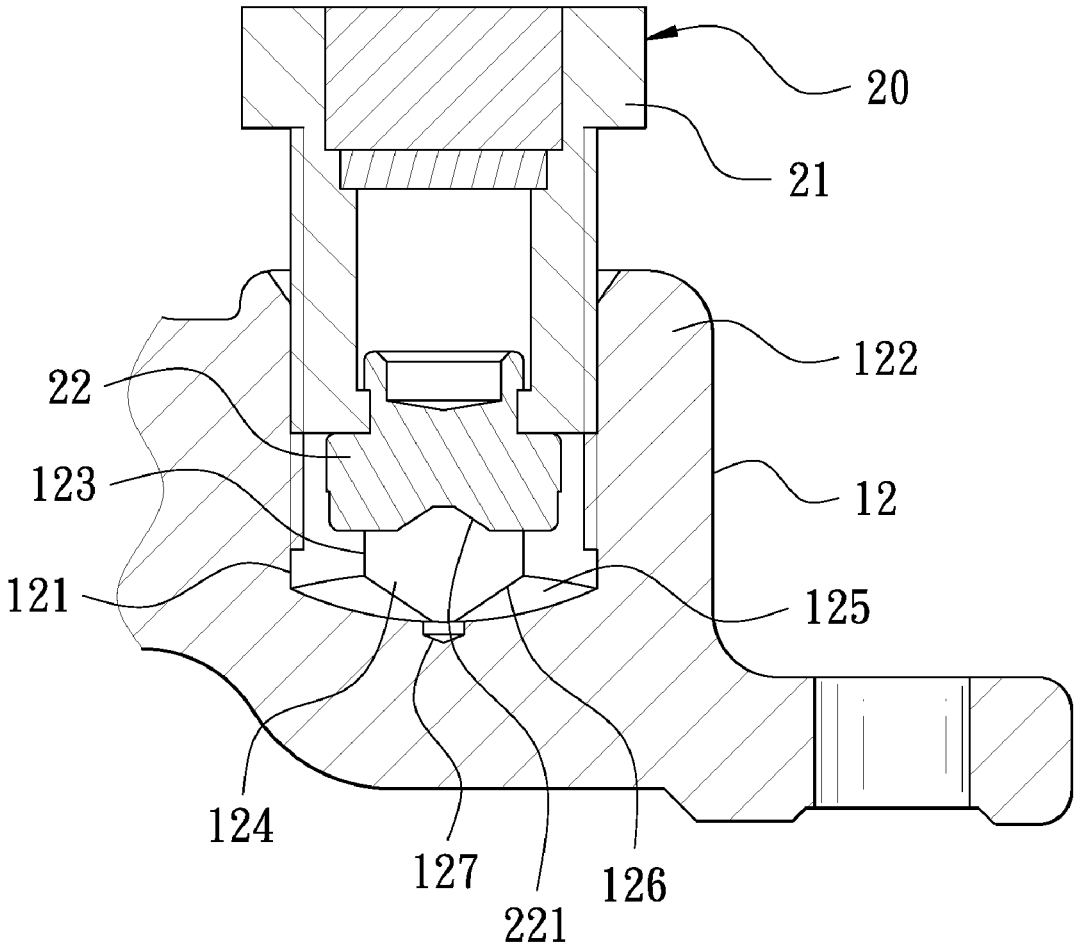
FIG. 5 is a sectional view of the spirally conjunct seat according to this invention.

With reference to FIG. 5, the packing unit 20 comprises a locking screw nut 21 and a packing block 22 oppositely wedged into the locking screw nut 21. The locking screw nut 21 can be spirally conjunct to the spirally conjunct slot 121 and the packing block 22 can be used to push down the lead wire 210. The packing block 22 is formed with a concave slot 221 opposite to one side of the bottom of spirally conjunct slot 121. The direction of concave slot 221 is identical to that of position limiting groove 124.

Figure 6:
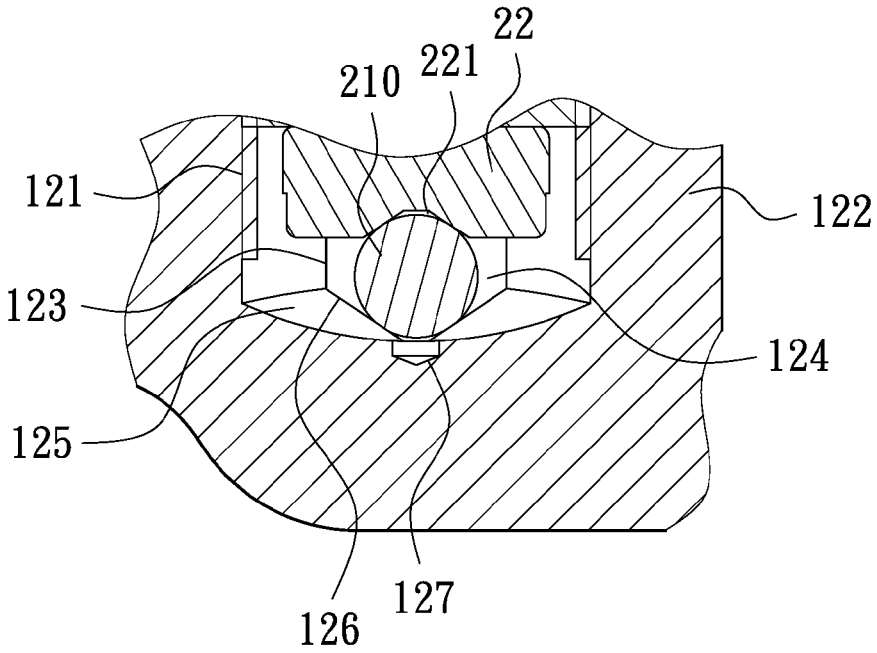
FIG. 6 is a schematic view illustrating a first service state of this invention clipping a big lead wire.
Figure 7:
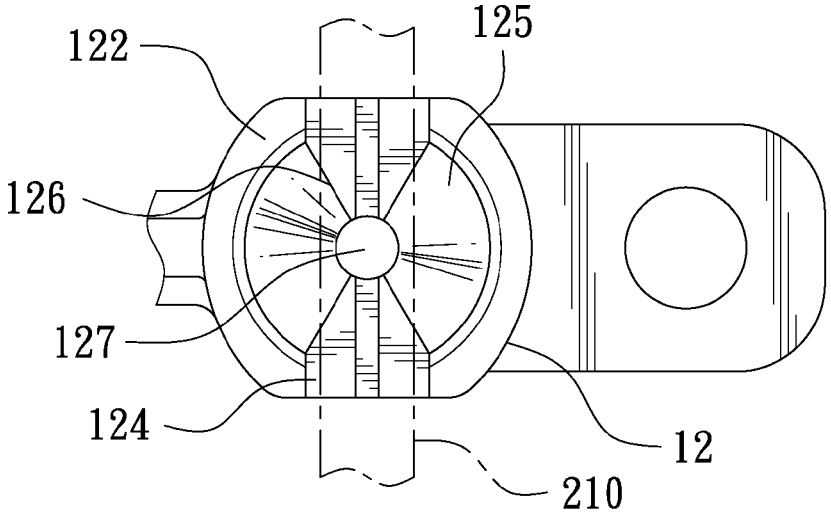
FIG. 7 is a schematic view illustrating a second service state of this invention clipping a big lead wire.

With reference to FIGS. 6 and 7 shown respectively as schematic views illustrating a first service state and a second service state of this invention clipping a big lead wire, when a clipping diameter is larger than that of lead wire 210, the lead wire 210 must be made to pass through the position limiting groove 124 from the slots 123. With the locking screw nut 21 spirally conjunct to the spirally conjunct slot 121, the packing block 22 can be further driven downwards by locking screw nut 21 to push down the top of lead wire 210 and limit the lead wire 210 lengthways to the position between the concave slot 221 and the position limiting groove 124. Further, the wedging crest lines 126 are used to generate a transversal wedging force applied to the lead wire 210 between the slots 123, which thereby prevents the lead wire 210 from being loose.

Figure 8:
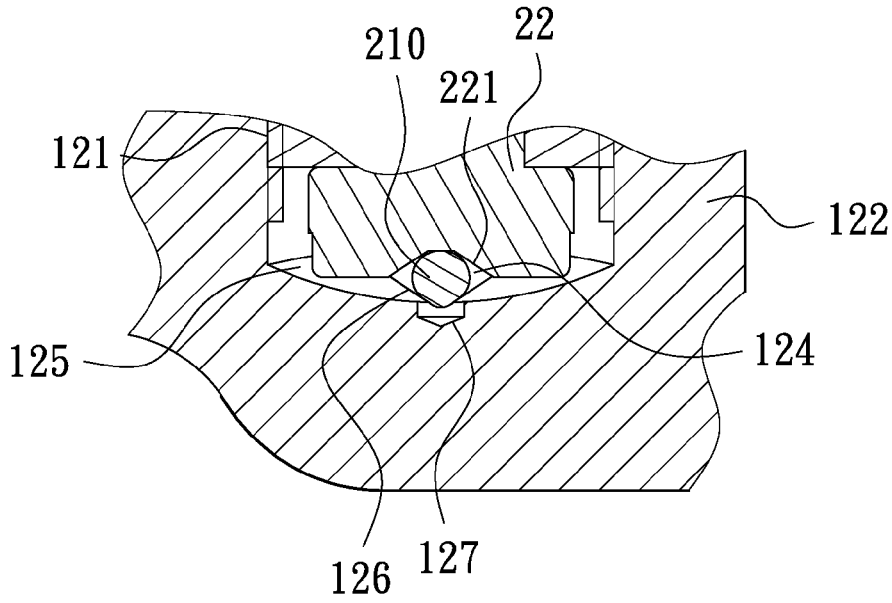
FIG. 8 is a schematic view illustrating a first service state of this invention clipping a small lead wire.
Figure 9:
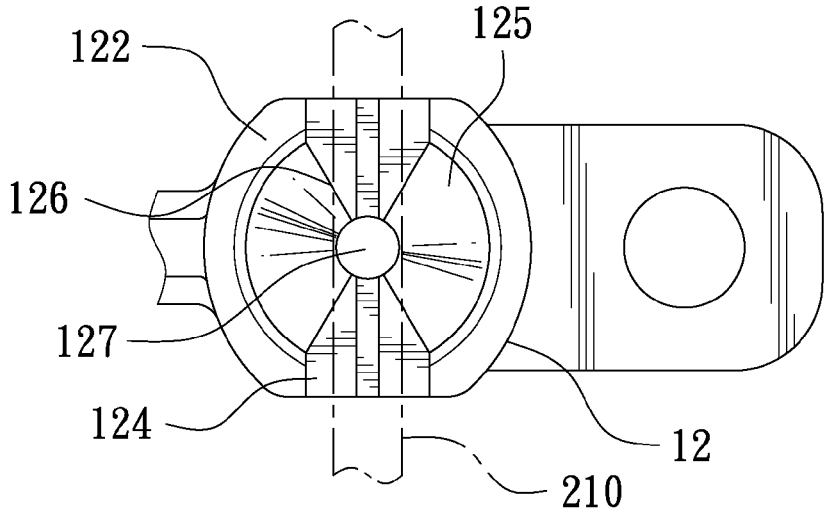
FIG. 9 is a schematic view illustrating a second service state of this invention clipping a small lead wire.

With reference to FIGS. 8 and 9 shown respectively as schematic views illustrating a first service state and a second service state of this invention clipping a small lead wire, when the clipping diameter is smaller than that of lead wire 210, the packing block 22 is also used to limit the lead wire 210 lengthways to the position between the concave slot 221 and the position limiting groove 124 and the wedging crest lines 126 are used to generate the transversal wedging force applied to the lead wire 210. Besides, when the lead wire 210 is repressed by the packing block 22, the lead wire 210 is bent in a determined degree and sunken in the container chamber 127, an transversal wedging force being thereby applied increasingly to the lead wire 210.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A wedge of a cable connector grounding device, comprising a body of which one side is formed with a spirally conjunct seat inside which a concave spirally conjunct slot is formed, two concave slots opposite to each other being formed on the circumferential wall of spirally conjunct seat, a packing unit is further provided is spirally connected to the spirally conjunct slot, being characterized in that:

at the bottom of spirally conjunct slot, a position limiting groove is formed from the concave slots towards the center, at the bottom of spirally conjunct slot, a concave camber is formed along the circumferential wall toward the center, and a wedge crest line is defined at a section of connection between the concave camber and the position limiting groove; and the center of bottom of the spirally conjunct slot is formed with a concave container chamber.

2. The wedge of cable connector grounding device according to claim 1, wherein the position limiting groove is generally a V-formed groove and brings to an end from the circumference of slot toward the edge of container chamber.

3. The wedge of cable connector grounding device according to claim 1, wherein the concave camber is generally in the form of a conic surface and is depressed by degree from the edge of inner side of the circumferential wall toward the container chamber.

4. The wedge of cable connector grounding device according to claim 1, wherein each of the wedge crest lines brings to an end from the inner side of circumferential wall, slanting toward container chamber.

5. The wedge of cable connector grounding device according to claim 1, wherein the packing unit further comprises at least one packing block, the packing block is formed with a concave slot opposite to one side of the bottom of spirally conjunct slot, and the direction of concave slot is identical to that of position limiting groove.

* * * * *